United States Patent [19]

DeWitt

[11] Patent Number: 4,992,002

[45] Date of Patent: Feb. 12, 1991

[54] APPARATUS FOR FORMING IN-GROUND CONCRETE PILINGS

[76] Inventor: Wayne DeWitt, 10816 SE. Evergreen, Vancouver, Wash. 98664

[21] Appl. No.: 529,486

[22] Filed: May 29, 1990

Related U.S. Application Data

[63] Continuation-in-part of Ser. No. 378,008, Jul. 11, 1989, abandoned.

[51] Int. Cl.[5] ..... E02D 5/34

[52] U.S. Cl. ..... 405/237; 405/233; 405/232

[58] Field of Search ..... 405/241, 240, 239, 233, 405/236, 242, 243

[56] References Cited

U.S. PATENT DOCUMENTS

| | | | |
|---|---|---|---|
| 1,157,443 | 10/1915 | Stewart | 405/242 |
| 1,477,567 | 12/1923 | Lancaster | 405/242 X |
| 2,010,778 | 8/1935 | Stechert | 405/240 |
| 3,084,518 | 4/1963 | Hochstrasser | 405/236 |
| 3,851,485 | 12/1974 | Steding | 405/239 X |
| 3,869,869 | 3/1975 | Pao Chen | 405/240 |
| 4,018,056 | 4/1977 | Poma | 405/233 |
| 4,618,289 | 10/1986 | Federer | 405/236 |

FOREIGN PATENT DOCUMENTS

| | | | |
|---|---|---|---|
| 708148 | 4/1931 | France | 405/242 |

*Primary Examiner*—Dennis L. Taylor

*Attorney, Agent, or Firm*—Chernoff, Vilhauer, McClung & Stenzel

[57] ABSTRACT

An apparatus for forming an in-ground concrete piling includes an elongate hollow mandrel which can be driven into the ground with a pile driver. A cupped foot, having a larger cross-sectional area than the mandrel, is placed beneath the mandrel before it is driven into the ground, and openings located near the bottom of the mandrel permit grout placed in the mandrel to flow into the space between the mandrel and the foot. A hollow sheath which slidably fits over the foot is attached to the bottom of an annular collar which slidably fits over the mandrel, forming a seal to prevent escape of grout from the openings while the mandrel is being filled. In use the mandrel is filled with grout before it is driven into the ground. Thereafter, during driving, the grout flows out of the openings in the bottom of the mandrel into the space around the mandrel, which is created by the foot. The column of grout in the mandrel acts as a static pressure head which forces the grout out of the mandrel into the surrounding space with a high volumetric flow rate as fast as the space is created.

10 Claims, 4 Drawing Sheets

APPARATUS FOR FORMING IN-GROUND CONCRETE PILINGS

CROSS-REFERENCE TO RELATED APPLICATION

This application is a continuation-in-part of applicationed Ser. No. 07/378,008, filed July 11, 1989 now abandoned.

BACKGROUND AND SUMMARY OF THE INVENTION

This invention relates to a method and apparatus for pouring in-ground concrete pilings, and in particular pilings which uniformly contact the surrounding soil over their entire extent and have a substantially constant cross-section throughout their length.

As the cost of steel has increased it has become cost effective to make pilings from concrete by casting them in place in the ground. This is accomplished by driving an elongate mandrel into the ground, filling the resultant hole with fluid grout, and then pulling the mandrel back out of the ground leaving the grout in place to cure. The holding ability of such a piling comes from end-bearing and from the friction which is created by the close contact between its sidewalls and the soil which surrounds it. It has become standard practice to place a foot, having a larger cross-sectional area than the mandrel, at its bottom before it is driven into the ground. The foot then forms an open space around the mandrel which also is filled with grout. In order to fill the hole created by the driving of the mandrel, grout is gravity fed into and/or around the mandrel as it is being driven into the ground. Examples of these devices are Steding, U.S. Pat. No. 3,851,485 and Poma, U.S. Pat. No. 4,018,056.

A problem with this procedure is that mandrels may be driven into the soil quite quickly, particularly when they are driven into soft soil. As a result, the grout often cannot flow into the hole fast enough to keep up with its formation. When this occurs, voids are formed around the resulting piling which reduce the amount of its frictional soil contacting surface. In addition, if soil or objects in the soil fall into these voids, the resultant pile diameter will neck down at the locations of the voids, adversely affecting the strength of the pile; also the mandrel may be more difficult to pull back out of the ground.

Several prior art devices have attempted to overcome this problem by pumping the grout into the mandrel under positive pressure as the mandrel is being driven. Examples of such devices are shown in Hochstrasser, U.S. Pat. No. 3,084,518 and Federer, U.S. Pat. No. 4,618,289. However, because grout is very viscous, it is difficult to maintain a sufficient volumetric flow rate through the pump to keep up with a fast-driving mandrel. Accordingly, pressure filling by means of a pump may be no more effective than gravity filling in soft soil conditions.

The subject invention overcomes the foregoing shortcomings of the prior art systems for forming in-ground concrete piling by employing a hollow mandrel as a grout reservoir having grout transmitting openings at the bottom of the mandrel. The long narrow mandrel is filled with grout prior to driving, thereby providing a high-volume reservoir which also has high static pressure.

The foot which is placed below the mandrel has a tubular side wall which extends upwardly from its bottom and surrounds the grout openings leaving an annular space between the sidewall of the foot and the mandrel into which grout can flow from the mandrel through the openings. An annular collar which fits slidingly around the mandrel provides a seal preventing grout from flowing out of the annular space while the foot is above ground proximate to the collar, but permitting such flow after the foot has been driven into the ground and is remote from the collar.

In use the mandrel is filled with grout before it is driven into the ground. A small amount of this grout flows out of the openings in the bottom of the mandrel and fills the annular space between the mandrel and the foot and the sliding clearance between the mandrel and the collar. However, the seal between the mandrel and the foot, and a sliding seal between the mandrel and the collar, prevent the grout from flowing out of the annular space. In addition, the collar is sufficiently weighted, or otherwise subjected to a sufficient downward force, that the high pressure created by the head of grout in the mandrel will not lift the collar off of the foot and permit the grout to escape.

After the mandrel is filled with grout it is driven into the ground using standard pile driving techniques. As the mandrel is driven into the ground and the foot forms a space between the mandrel and the soil, this space is filled with grout immediately as it is being formed, even at high driving speeds. This is made possible by two factors. First, the grout stored at a great height in the long, prefilled mandrel creates high static pressure at the bottom of the mandrel which is equal to or greater than that which could be produced by most pumps. Second, because the hollow interior of the mandrel provides enough grout storage preferably to pour the entire piling, or at least the majority thereof, there is no limitation on volumetric flow rate as would be imposed by most pumps. Thus, the invention supplies grout to the space between the mandrel and the soil as quickly as this space is created and the resulting piling thus has no voids and contacts the soil over its entire extent.

Once the mandrel is driven to the required depth it is pulled back out of the ground leaving the grout in place where it will cure into a concrete piling.

According to another aspect of the invention, the mandrel is optionally provided with an upwardly-facing reaming surface adjacent its lower end which, as the mandrel is pulled back out of the ground, compresses any soil, which may intrude into the hole formed by the foot, radially outwardly so that the intrusion is removed. This further ensures against any necking down of the resultant pile diameter.

Accordingly, it is a principal object of the present invention to provide an apparatus for forming in-ground concrete pilings with a removable mandrel which results in the formation of a pile which substantially uniformly contacts the surrounding soil and is of substantially uniform diameter from top to bottom without necked-down areas adversely affecting its strength.

It is a further principal object of the present invention to provide an apparatus for forming in-ground concrete pilings with a removable mandrel in which the fluid concrete is first stored and then flows into the space created around the mandrel as that space is being formed.

It is a further object of the present invention to provide such an apparatus wherein the mandrel is filled with fluid grout before it is driven into the ground.

It is a still further object of the subject invention to provide such an apparatus which prevents the grout from flowing out of the mandrel when it is filled prior to driving.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
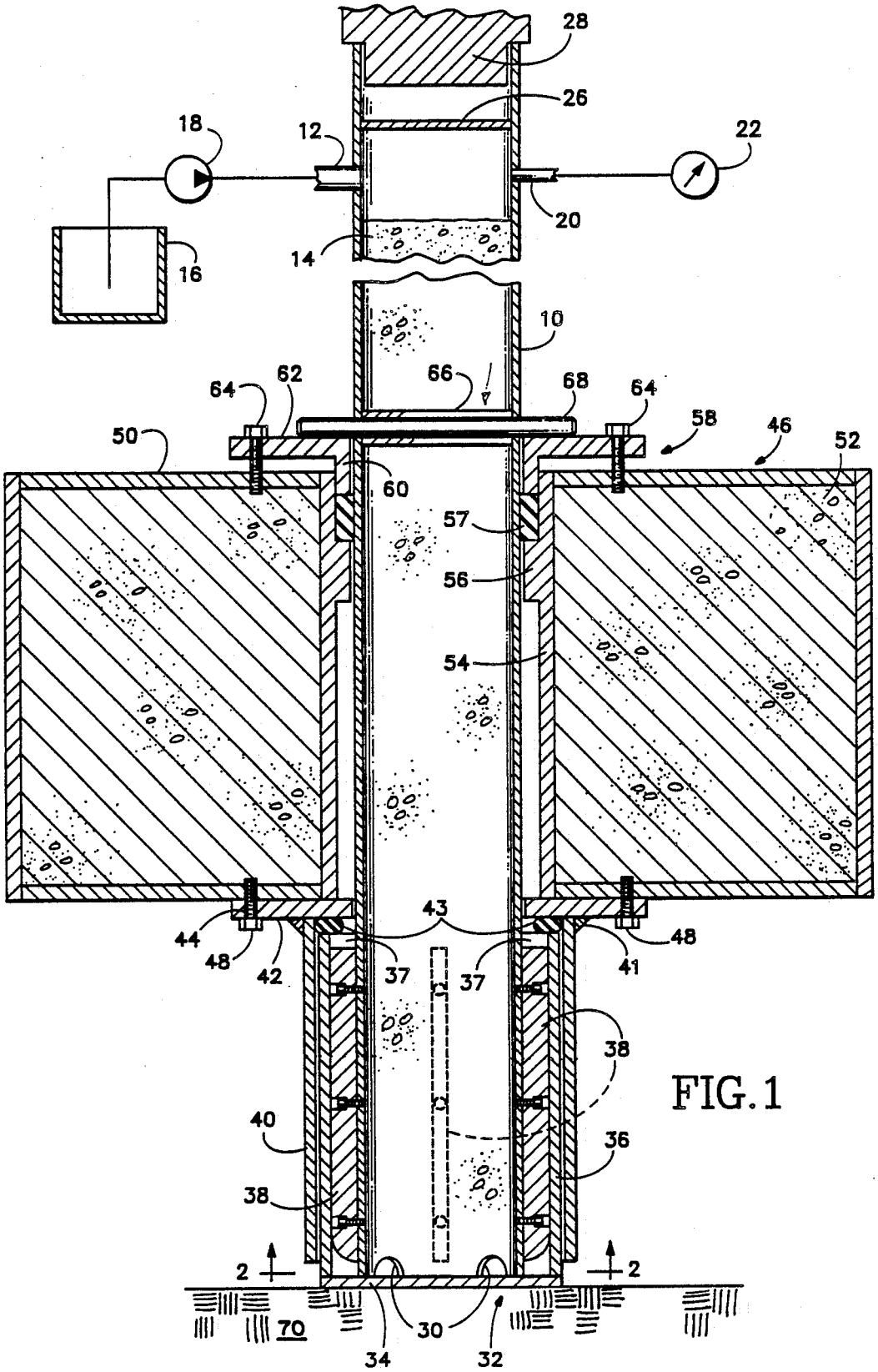
FIG. 1 is a foreshortened side elevation view, in cross-section, of a first embodiment of the subject invention.

Referring to FIG. 1, the apparatus of one embodiment of the present invention includes an elongate hollow mandrel 10. The mandrel is made from a strong, relatively hard material, such as APIN-80 steel, which will permit it to be repeatedly driven into the ground. The mandrel is somewhat longer than the deepest piling which is to be formed with it, and its cross-sectional shape is similar to, but slightly smaller than, the cross-sectional shape of the resulting piling. The mandrel shown in the drawings is circular in cross-section, which is the preferred shape. Located near the top of the mandrel is a grout inlet 12 which will allow fluid grout 14 to be pumped into the mandrel from a grout supply 16 by means of a conventional grout pump 18. Also located near the top of the mandrel is a pressure tap 20 which is connected to a remote pressure gauge 22 preferably located at ground level. The upper end of the mandrel shown in the drawings is enclosed by a recessed cap 26 which forms a depression for accepting the driving head 28 of a pile driver (not shown). Located at the bottom of the mandrel are a plurality of grout transmitting openings 30 which will permit fluid grout placed into the mandrel to flow out of its lower end.

Located at the bottom of the mandrel is a foot 32 which encloses the mandrel's lower extremity. The foot includes a circular disk 34 of larger diameter than the outside diameter of the mandrel, clearing the way for the mandrel when the mandrel is driven into the ground. Since the diameter of the foot is larger than that of the mandrel, the hole created by driving the mandrel and the foot into the ground is larger than the mandrel itself. In the embodiment illustrated, the foot 32 includes a cylindrical sidewall 36 which extends up over the lower portion of the mandrel 10 creating an annular space 37 between the mandrel and the sidewall 36. Vanes 38, which are bolted to the lower extremity of the mandrel extend from the mandrel into sliding abutment with the sidewall of the foot to center the foot axially on the mandrel.

A cylindrical weighted collar assembly 46 has a cylindrical sheath 40 depending therefrom. The sheath 40 has an inside diameter which is slightly greater than the outside diameter of the sidewall 36 of the foot, and a length which is approximately equal to but no longer than the length of the sidewall. An annular attachment ring 42 is permanently attached to the top end of the sheath, such as by an annular fillet weld 41. An annular seal 43, such as a resilient O-ring or gasket, matingly rests on the top of the sidewall 36 of the foot when the foot is above ground as shown in FIG. 1. The attachment ring 42 has an inside diameter which is slightly larger than the outside diameter of the mandrel and an outside diameter which is significantly larger than the outside diameter of the sheath, and is concentrically mounted on the sheath. The attachment ring has a plurality of holes 44 located proximate its periphery which allows it to be attached, by means of bolts 48, to the cylindrical collar assembly 46. The collar assembly is an annular cylinder with an inside diameter which allows it to fit freely over the mandrel. The outside diameter and height of the collar depend upon how much it must weigh to perform its intended function, which will be explained below. However, its outer diameter must be significantly larger than the diameter of the mandrel so that its bottom has sufficient surface area that it will not follow the mandrel into the ground when the mandrel is being driven. In the embodiment illustrated, the collar is a hollow drum 50 which is filled with concrete 52.

Located near the top of the inner wall 54 of the collar is a shoulder 56, above which is a compressible packing seal 57 which nominally fills the space between the inner wall 54 of the collar and the mandrel. An annular compression ring 58 has a vertical tube portion 60 which fits into the gap between the inner wall of the collar and the mandrel, and an annular flange portion 62 which overlies the top surface of the collar. Bolts 64 pull the flange 62 toward the weight when tightened thereby enabling the seal 57 to be compressed as desired. Since the attachment ring 42, shoulder 56, and compression ring 58 all slidably fit over the mandrel they serve to align the mandrel with respect to the collar so that there is no binding when the mandrel slides through the collar.

A cylindrical sleeve 66 optionally extends through the mandrel immediately above where the top of the collar would lie when the seal 43 rests on the sidewall 36 of the foot. A pin 68 can be slidably placed in the sleeve 66 when desired to prevent the collar from moving upwardly along the mandrel, as will be more fully described later.

Figure 3:
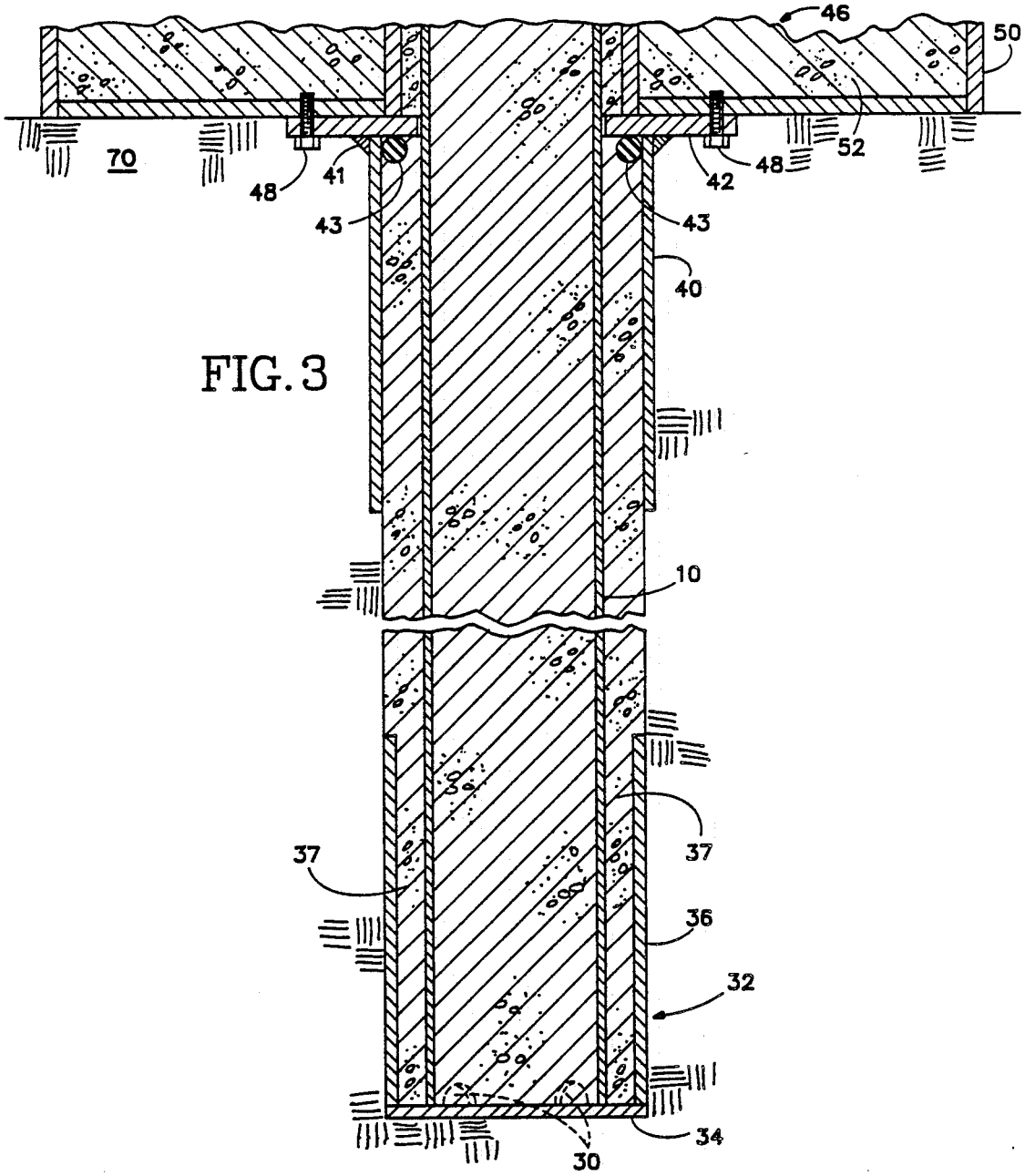
FIG. 3 is a side elevation view, in cross-section, similar to FIG. 1, showing the first embodiment when the piling is partially formed.
Figure 2:
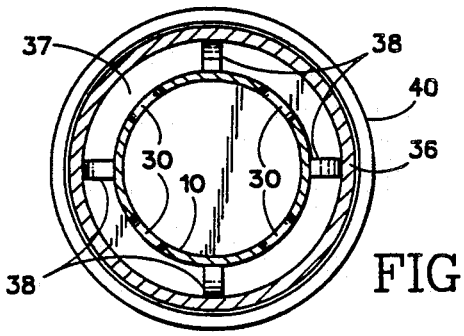
FIG. 2 is a cross-sectional view taken along the line 2—2 of FIG. 1.

The method by which the apparatus of the embodiment of FIGS. 1-3 is used to form a piling includes inserting the assembled apparatus into a pile driver (not shown) so that the mandrel 10 is vertical with the collar assembly 46 surrounding it and the foot 32 is on the ground 70 as shown in FIG. 1. The pump 18 then is activated to pump fluid grout from the grout supply 16 into the mandrel through the grout inlet 12 until the mandrel is filled to the proper level. Preferably, just enough grout is placed into the mandrel to completely form the desired piling. This requires that the mandrel be filled to a height above the length that it will be driven into the ground since the hole formed by the foot 32 is larger in cross section than the mandrel and there must be sufficient grout to fill the resulting space outside of the mandrel as well as the space inside the mandrel. The pressure gauge 22 can be used to determine how high the mandrel is filled with grout since the air in the mandrel will be compressed as the mandrel is filled. While the pressure in the mandrel is not an exact measure of the degree of fullness, it is indicative and is very helpful. As the mandrel is being filled, a small amount of grout flows out of the grout transmitting openings 30 and up into the space 37 between the sidewall 36 of the foot and the mandrel. However, the containment provided by the contact of the annular seal 43 with the top of the sidewall 36 prevents the grout from escaping outwardly of the space 37, while the seal 57 prevents grout from escaping past the top of the collar 46. Accordingly, the seals prevent any further flow of grout out of the openings 30. Although the collar is weighted so that it will resist the static pressure of the entire col of grout in the mandrel without being lifted, the pin 68 may be installed during the filling of the mandrel, if desired, to ensure that the collar is not lifted. Due to the fact that the entire mandrel is above ground and the grout is dropping dynamically into the mandrel while it is being filled, the maximum lifting force is created during this part of the operation.

Once the mandrel is filled, the pin 68 is removed and the pile driver starts to drive the mandrel and foot into the ground. Due to the collar 46 and the small size difference between the sheath 40 and the foot, the sheath will follow the mandrel into the ground until the collar contacts the ground. The mandrel then will slide through the collar and sheath as it is driven further into the ground as shown in FIG. 3. As the mandrel is driven into the ground the grout flows out of the grout transmitting openings 30 and through the annular space 37 into the space being formed above the foot; since the annular seal 43 no longer prevents the escape of the grout from the annular space 37 into the ground. Because the mandrel is filled with grout through the entire driving operation, there is a ready volumetric supply of grout to flow out of the openings 30 at all times. Furthermore, due to the high static pressure of the head created by the column of grout in the mandrel, the grout flows readily out of the openings 30 and completely fills the space around the mandrel even at high driving speeds. Thus, the space around the outside of the mandrel is filled quickly with no voids to form a piling which reliably contacts the surrounding soil over its entire extent.

After the mandrel has been driven to its desired depth, it is removed by pulling it back up out of the ground. The foot remains at the bottom of the piling as the vanes 38 slidably disengage from the sidewall 36 of the foot. Since the mandrel is surrounded by fluid grout it is easily pulled free and, when the vanes 38 contact the annular ring 42 at the bottom of the collar 46, the collar is also pulled free. The entire assembly is then ready for reuse with a new foot. As the mandrel is pulled out of the grout a vacuum may start to build in the air space at the top of the mandrel, thereby causing a steadily increasing negative pressure to register on the pressure gauge 22. If this condition is not corrected by temporarily interrupting the pulling procedure, grout may be pulled out of the hole with the mandrel. Thus, the pressure gauge 22 serves to warn the operator of this condition, which permits proper corrective action to be taken to relieve the vacuum.

Figure 4:
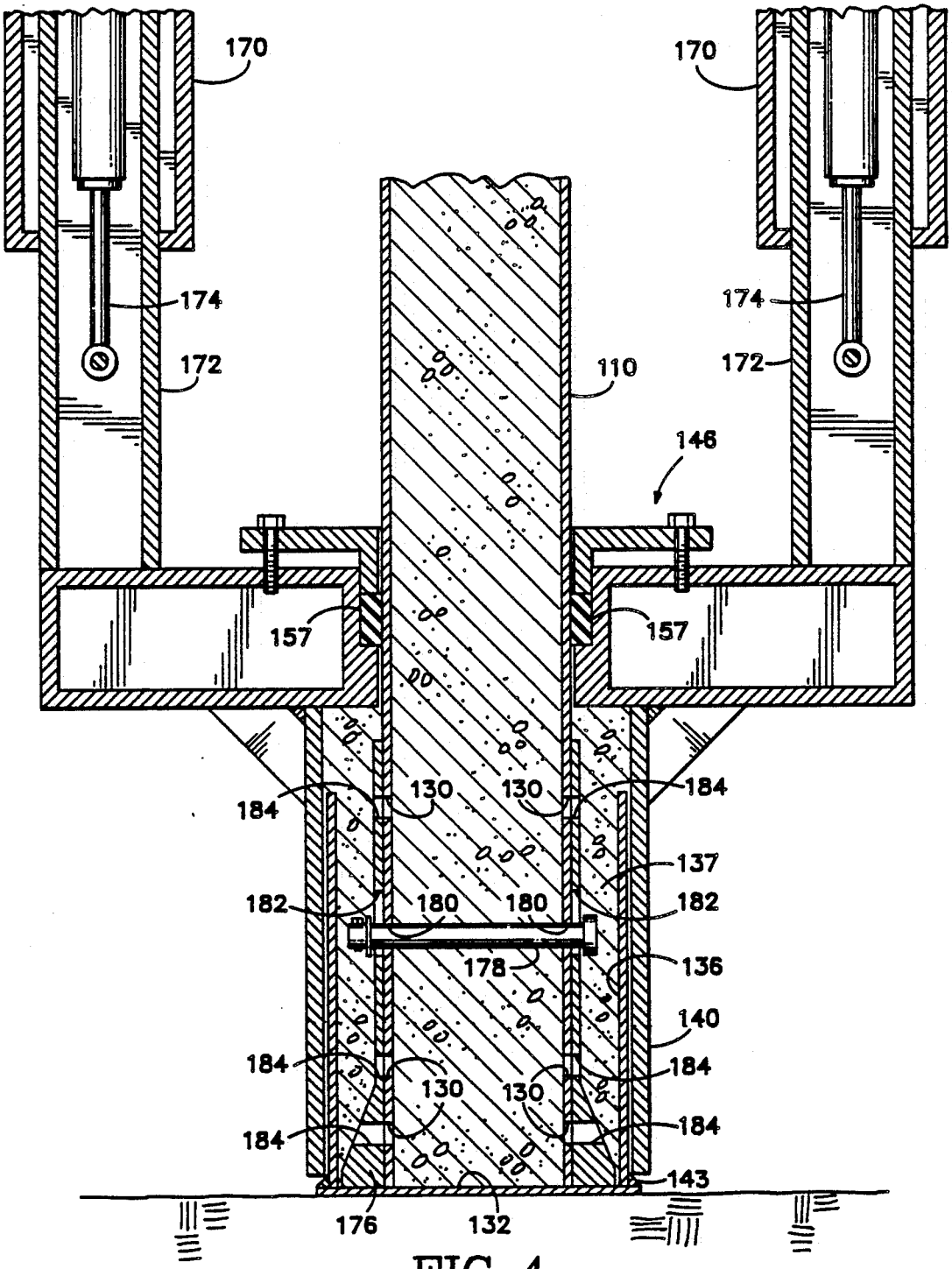
FIG. 4 is a foreshortened side elevation view, in cross-section, of a second embodiment of the invention.
Figure 5:
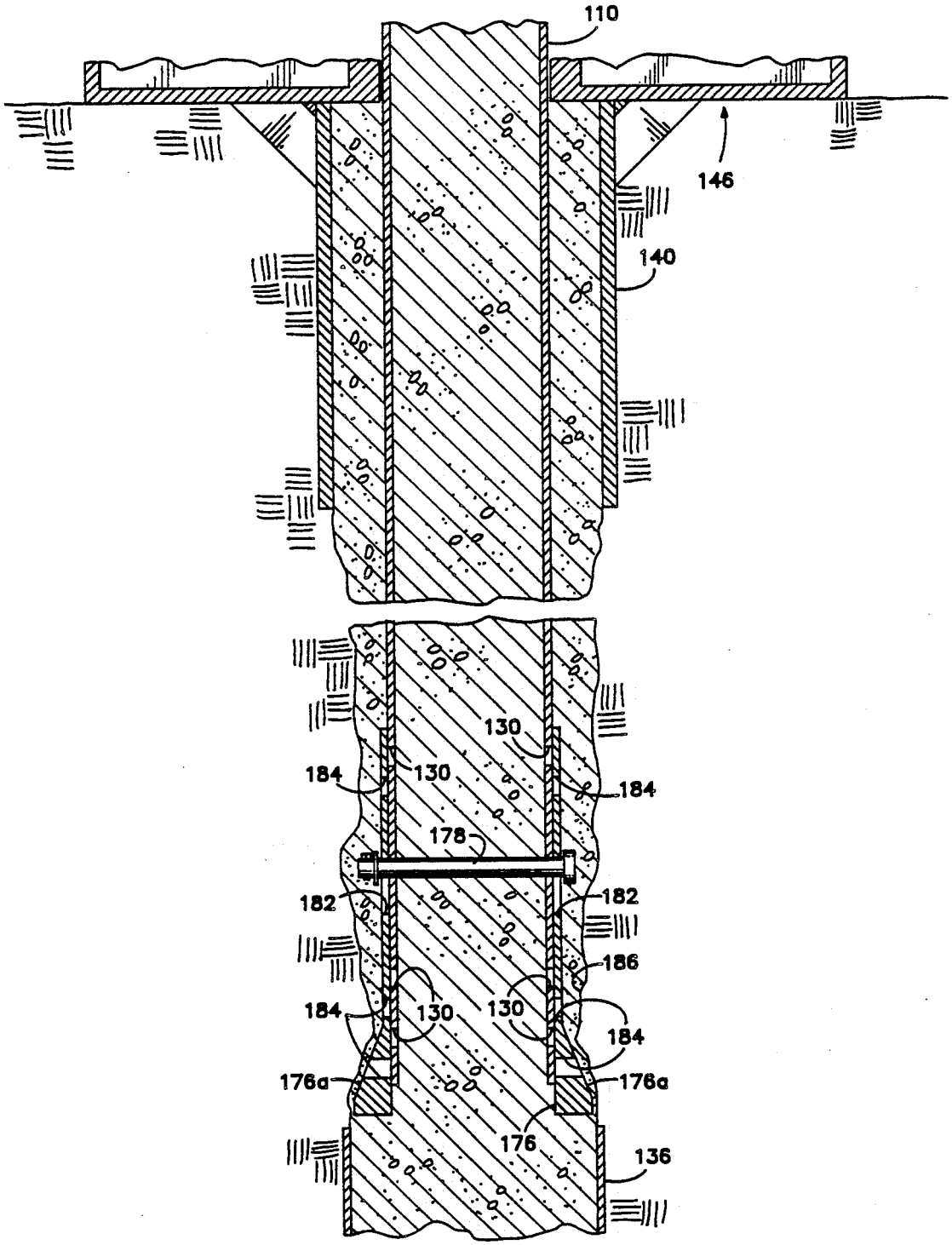
FIG. 5 is a cross-sectional view, similar to FIG. 4, showing the second embodiment while the mandrel is being withdrawn from the ground.

FIGS. 4 and 5 show an alternative embodiment of the invention similar in structure and use to the embodiment of FIGS. 1–3. Accordingly, the following discussion will emphasize only the differences between the embodiment of FIGS. 4–5 and the embodiment of FIGS. 1–3. The mandrel 110 has a plurality of grout-transmitting apertures 130 which permit fluid grout placed into the mandrel to flow out of its lower end and into an annular space 137 between the mandrel 110 and the cylindrical sidewall 136 of the foot 132. A cylindrical collar assembly 146 slidably surrounds the mandrel and has a cylindrical sheath 140 depending therefrom. The lower edge of the sheath 140 sealingly rests on a fillet weld 143 peripherally surrounding the bottom of the foot 132 while the mandrel 110 is being filled with grout prior to the driving process. The seal between the peripheral fillet weld 143 and the bottom edge of the sheath 140, and an annular packing seal 157 near the top of the collar 146, prevent the grout from escaping from the annular space 137 while the mandrel 110 is being filled prior to driving.

The collar 146 is significantly less massive than the weighted collar 46 of the embodiment of FIGS. 1–3, since the collar 146 does not rely merely upon its own weight to resist the pressure of the grout inside the mandrel 110. The collar 146 is slidably connected to the pile driver 170 by a pair of vertical slides 172 which are selectively extensible or retractable relative to the pile driver 170 by hydraulic piston and cylinder assemblies 174, the piston rods of which are connected to the slides 172 and the cylinders of which are connected to the pile driver 170. Extension of the piston and cylinder assemblies 174 imposes the massive weight of the pile driver upon the collar 146 when it is necessary to establish the grout-retaining seal between the sheath 140 and the peripheral fillet weld 143 of the foot 132 during filling of the mandrel 110. Extension of the piston and cylinder assemblies also drives the sheath 140 into the ground. Conversely, retraction of the piston and cylinder assemblies 174 enables the sheath 140 to be raised above the ground for positioning of a mandrel slidably through the collar and positioning of a foot 132 beneath the mandrel prior to driving. Such retraction also permits the installation or removal of an optional reaming device 176 on the bottom of the mandrel 110 as described hereafter.

Prior to driving, after the mandrel 110 has been inserted through the collar 146 while the collar is retracted upwardly by the piston and cylinder assemblies 174, the reaming device 176 may be slipped matingly onto the bottom of the mandrel 110 and fastened in longitudinally sliding relationship thereto by a pin 178, which fits snugly through a pair of diametrically-opposed apertures 180 in the mandrel and slidably through a pair of elongate slots 182 in the reaming device 176. The reaming device has grout-transmitting apertures 184 which are slidably alignable with the corresponding grout-transmitting apertures 130 of the mandrel 110 when the bottom surface of the reaming device 176 is flush with the bottom edge of the mandrel 110. Thus, as long as the bottom edge of the mandrel and the bottom surface of the reaming device are both resting on the bottom of the foot 132, the grout-transmitting apertures 130 and 184 are aligned and grout may freely pass from inside the mandrel to the peripheral space 137 between the mandrel and the cylindrical sidewall 136 of the foot 132. Thus, the apertures 130 and 184 are aligned both during initial filling of the mandrel and during the driving thereof. After driving of the mandrel has been completed, however, and the mandrel is being withdrawn from the hole as shown in FIG. 5 leaving the foot behind, the reaming device 176 slides downwardly relative to the mandrel until its sliding movement is stopped by the abutment of the pin 178 with the tops of the slots 182. This sliding movement misaligns all of the grout-transmitting apertures 184 with respect to the apertures 130, thereby closing the apertures and preventing the passage of grout or any other material through the apertures. However grout may now flow directly out the bottom of the mandrel 110 since the bottom is no longer blocked by the foot 132 during withdrawal of the mandrel.

The purpose of the reaming device 176 is to compact any soil portions, such as 186 which may have intruded into the hole formed by the foot during driving, in a radially outward direction during withdrawal of the mandrel. The reaming device 176 accomplishes this by means of its frusto-conical, upwardly facing, outer peripheral surface 176*a*. As the mandrel 110 is withdrawn, grout located above the reaming device 176 in the annular space surrounding the mandrel 110 is forced to flow vertically around the outside of the surface 176*a* due to the grout's high static pressure, compressing the soil radially outwardly to an extent greater than that which would be caused merely by physical contact between the soil and the surface 176*a*. The purpose of the misalignment and resultant closure of the grout transmitting apertures 184 and 130 during the withdrawal process is twofold: first, such closure prevents any of the intruding soil from being forced through the apertures into the interior of the mandrel during the withdrawal process, where it would displace grout in the core of the resulting pile and thereby weaken the pile; and, second, it prevents the grout in the annular space surrounding the mandrel from flowing back into the interior of the mandrel during withdrawal, thereby forcing it to flow around the outside of the surface 176*a*. There is no danger of any grout voids being formed below the reaming device 176 during the withdrawal procedure, because all areas below the reaming device are fully exposed to the reservoir of grout within the mandrel 110 through the open bottom thereof during withdrawal.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for forming an in-ground concrete piling comprising:

(a) an elongate, drivable, hollow mandrel having a hollow interior, an upper end and a lower end, said mandrel having grout transmitting openings located proximate said lower end for conducting grout outwardly from said hollow interior into an exterior area surrounding said mandrel;

(b) foot means at the lower end of said mandrel for forming a hole which is larger in cross section than the cross section of said mandrel when said mandrel is driven into the ground;

(c) a collar having a central opening longitudinally slidably receiving said mandrel;

(d) means for introducing fluid grout into said hollow interior of said mandrel; and (e) sealing means on said collar for preventing the flow of grout from said hollow interior of said mandrel outwardly through said grout transmitting openings when said collar and foot means are proximate to each other, and permitting said flow when said collar and foot means are remote from each other, said hollow interior of said mandrel and said sealing means cooperating as means for receiving and retaining an elongate vertical column of fluid grout within said mandrel extending upwardly above said grout transmitting openings and above the level of any fluid grout in said exterior area surrounding said mandrel.

2. The apparatus of claim 1, including alignment means interacting between said collar and mandrel for preventing said mandrel from binding in said central opening.

3. The apparatus of claim 1, including centering means interacting between said foot means and mandrel for centering said foot means axially on said mandrel.

4. The apparatus of claim 3 wherein said foot means comprises a hollow shell having an upper end which is open and a lower end which is closed.

5. The apparatus of claim 4 wherein said centering means comprises a plurality of vanes which extend outwardly from said mandrel and slidingly abut said hollow shell.

6. The apparatus of claim 1 wherein said collar has a tubular sheath depending therefrom for fitting matingly around said foot means.

7. Apparatus for forming an in-ground concrete piling comprising:

(a) an elongate, drivable, hollow mandrel having an upper end and a lower end, said mandrel having grout-transmitting apertures located proximate said lower end;

(b) means defining a downwardly-facing surface adjacent the lower end of said mandrel for forming a hole which is larger in cross section than the cross section of said mandrel when said mandrel is driven into the ground;

(c) means defining an upwardly-facing reaming surface adjacent the lower end of said mandrel for forming a hole which is larger in cross section than the cross section of said mandrel when said mandrel is withdrawn from the ground; and (d) means for selectively opening and closing said grout-transmitting apertures so as to open said apertures in response to the driving of said mandrel into the ground and close said apertures in response to the withdrawal of said mandrel from the ground.

8. The apparatus of claim 7 wherein said mandrel includes an elongate sidewall defining a hollow tube, said grout transmitting apertures being located in said sidewall proximate said lower end.

9. An apparatus for forming an in-ground concrete piling comprising:

(a) an elongate, drivable, hollow mandrel having an upper end and a lower end, said mandrel having grout transmitting openings located proximate said lower end;

(b) foot means at said lower end of said mandrel for forming a hole which is larger in cross section than the cross section of said mandrel when said mandrel is driven into the ground;

(c) a collar having a central opening longitudinally slidably receiving said mandrel;

(d) means for introducing fluid grout into said hollow mandrel;

(e) sealing means on said collar for preventing the flow of grout from said mandrel outwardly through said grout transmitting openings when said collar and foot means are proximate to each other, and permitting said flow when said collar and foot means are remote from each other;

(f) said sealing means including selectively operable force-applying means for selectively pressing said collar downwardly toward said lower end of said mandrel.

10. The apparatus of claim 9 wherein said force-applying means includes a fluid power piston and cylinder assembly.

* * * * *